US005799644A

United States Patent [19]

Nishida

[11] Patent Number: 5,799,644

[45] Date of Patent: Sep. 1, 1998

[54] SEMICONDUCTOR SINGLE CRYSTAL INGOT CUTTING JIG

[75] Inventor: Kouji Nishida, Oiso-Machi, Japan

[73] Assignee: Komatsu Electronic Metals Co., Ltd., Hiratsuka, Japan

[21] Appl. No.: 734,780

[22] Filed: Oct. 22, 1996

[51] Int. Cl.[6] ..... B24B 41/06

[52] U.S. Cl. ..... 125/35; 451/364; 451/460; 269/7

[58] Field of Search ..... 125/35, 13.01, 125/13.02; 451/460, 389, 388, 390, 364; 267/7, 21

[56] References Cited

U.S. PATENT DOCUMENTS

| | | | |
|---|---|---|---|
| 4,227,348 | 10/1980 | Demers | 125/13.01 |
| 4,819,387 | 4/1989 | Harbarger | 125/13.01 |
| 4,903,681 | 2/1990 | Honda et al. | 269/21 |
| 5,024,207 | 6/1991 | Harbarger et al. | 125/35 |
| 5,367,837 | 11/1994 | Tolkowsky | 451/460 |
| 5,413,521 | 5/1995 | Terashima et al. | 125/13.01 |

FOREIGN PATENT DOCUMENTS

| | | | |
|---|---|---|---|
| 0068480 | 6/1978 | Japan | 269/7 |

*Primary Examiner*—Robert A. Rose
*Attorney, Agent, or Firm*—Varndell Legal Group

[57] ABSTRACT

A semiconductor single crystal ingot cutting jig is shaped as a cylinder having a diameter approximately equal to an ingot diameter. A recess is provided at one end of the jig for receiving a head (or tail) of the ingot. An adhesive is provided in the recess so as to adhere the ingot to the jig when the head (or tail) of the ingot is inserted into the recess. Then, the ingot is fixed on a bed of a band-saw slicing machine. The head (or tail) of the ingot is fixed on the jig and thus will not overturn at the time just before finishing the cutting or at the end of cutting. This can prevent a blade of a band saw slicing machine from being damaged.

2 Claims, 2 Drawing Sheets

SEMICONDUCTOR SINGLE CRYSTAL INGOT CUTTING JIG

BACKGROUND OF THE INVENTION

1. Field of the Invention

The present invention relates to a semiconductor single crystal ingot cutting jig, especially to a jig used during cutting the heads and tails of semiconductor single crystal ingots.

2. Description of Prior Art

The substrate of a semiconductor device primarily consists of high purity single crystal silicon. The Czochralski Method (hereafter called the CZ method) is one of the methods to produce single crystal silicon and has been widely used. In the CZ method, polycrystal silicon is put into a crucible in a chamber of a semiconductor single crystal pulling apparatus. A heater is provided around the crucible to heat and melt the polycrystal silicon. A seed crystal is mounted in a seed chuck and is immersed in the melted polycrystal silicon. Then single crystal silicon can be grown by pulling up the seed chuck while rotating the seed chuck and the crucible in the same or opposite directions.

The Floating Zone Melting Method (hereafter called the FZ method) is another method to produce single crystal silicon, wherein a bar-like polycrystal silicon is hung on a material holder attached to an upper shaft of a semiconductor single crystal manufacturing apparatus while a small diameter seed is held on a seed crystal holder attached to a lower shaft of the apparatus. Then, a high-frequency induction heating coil is used to heat and melt one end of the polycrystal silicon, and the melted polycrystal silicon adheres to the seed. Then reducing a dislocation by necking process, the polycrystal silicon and single crystal silicon (the seed) are rotated in opposite directions, and then a floating zone of the polycrystal silicon is moved, by means of vertically moving the high-frequency induction heating along the polycrystal silicon, to obtain a refined single crystal silicon.

The single crystal silicon ingot (made according to the CZ Method or FZ Method) is then cooled, ground (until its outer diameter equal to a predetermined size) and cut to obtain silicon wafers. In the cutting processes, its head and tail are cut away, and its body is cut into a plurality of blocks. Each block is then cut into wafers. Alternatively, only its head is cut away at first. Then, its body is sliced into a plurality of sections. Then its tail is cut away.

Conventionally an outer diameter saw slicing machine is used to cut the head and tail of a single crystal silicon ingot (hereafter briefly called ingot), which has a rotatable thin disk with abrasive grains (such as diamonds) provided on its periphery. The thin disk can be rotated to cut a bar-like ingot held in a V-groove. Furthermore, an endless band saw slicing machine (hereafter called a band saw slicing machine) is used to cut the body of an ingot, which has two pulleys enveloped by an endless steel band and has abrasive grains (such as diamonds) adhered to one end of a ring-shaped thin steel band to function as a blade. A bar-like ingot held in a V-groove can be cut by rotating the two pulleys and moving the blade. Using the band saw slicing machine, therefore, the ingot can be divided into blocks, the divided blocks can be further cut into wafers for examination.

However, some problems arise when the above two cutting machines are used for cutting ingots:

(1) After the head and tail of an ingot are cut by the outer diameter saw slicing machine, the body of the ingot needs to be moved to the band saw slicing machine. In other words, moving time and waiting time (waiting for being sliced) are required. As a result, a considerable amount of total time is required for the cutting processes.

(2) To solve the above problem, the band saw slicing machine is thus used to cut the head and tail of the ingot. However, the conical head 2*a* (or tail) of the ingot 2 overturns into a V-groove of the bed 3 at the time just before finishing the cutting or at the end of cutting, as shown in FIG. 6. This causes the blade of the band saw 5 to be pinched by the lower portion of the cut and to be damaged. A supplementary description is that a carrying platform 9, as shown in FIG. 7, is arranged at lower position than the ingot held in a V-groove of an ingot fixing platform 8. By this arrangement, the head 2*a* (or tail) cut by the outer diameter blade 10 falls down to the carrying platform 9. This can avoid damaging the outer diameter blade.

(3) The blade of the outer diameter saw slicing machine is thicker than that of the band saw slicing machine. For example, the blade of an outer diameter saw slicing machine is 2.5 mm thick, while the blade of a band saw slicing machine is 0.5 mm thick. Therefore, the kerf loss by the outer diameter saw slicing machine is greater than that by the band saw slicing machine. This will reduce the yield of semiconductor wafers.

SUMMARY OF THE INVENTION

An object of the present invention is to provide a semiconductor single crystal ingot cutting jig, to solve the above-mentioned problems, by which a band saw slicing machine can be used to successively cut an ingot's head, tail and body.

In accordance with the object of the present invention, there is provided a semiconductor single crystal ingot cutting jig which is shaped as a cylinder having a diameter approximately equal to an ingot diameter. A conical recess is provided at one end of the jig for receiving a head (or tail) of the ingot. An adhesive is filled in a clearance between the recess and the head (or tail) of the ingot so as to adhere the ingot to the jig when the head (or tail) of the ingot is inserted into the recess.

Furthermore, a heater can be provided near the recess to heat and soften a thermoplastic resin filled in the clearance between the recess and the ingot head (or tail). Alternatively, both a heater and cooling water passages are provided near the recess. A thermoplastic resin filled between the recess and the ingot head (or tail) can be heated and softened by the heater. Then, cooling water can be introduced through the cooling water passages so as to cool and harden the thermoplastic resin.

The head (or tail) of ingot is adhered to the cylindrical jig whose diameter is approximately equal to the ingot diameter. As a result, the ingot head or tail are also fixed on the jig and will not overturn on the bed 3 while being cut by the band saw slicing machine. This can prevent a band saw of the slicing machine from getting damaged. Also, the band saw slicing machine can be used for cutting the ingot head, tail and successively body from first to last.

BRIEF DESCRIPTION OF THE DRAWINGS

The present invention can be more fully understood by reading the subsequent detailed description and examples with references made to the accompanying drawings, wherein.

DETAILED DESCRIPTION OF THE PREFERRED EMBODIMENT

Figure 1:
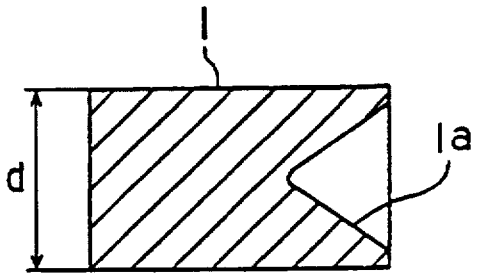
FIG. 1 is a sectional diagram of a semiconductor single crystal ingot cutting jig according to the first embodiment of this invention.
Figure 2:
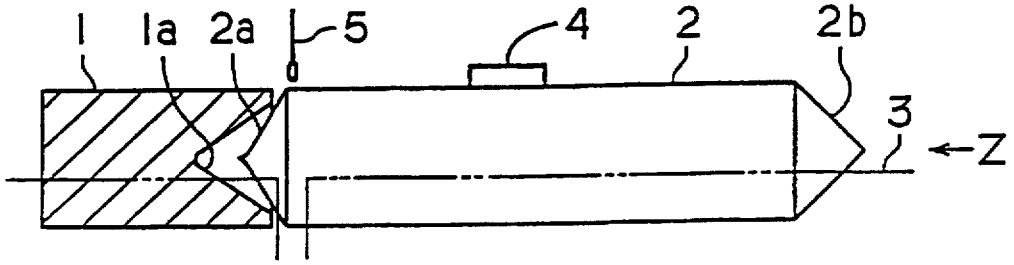
FIG. 2 shows that a head of an ingot is cut by a band saw slicing machine.
Figure 3:
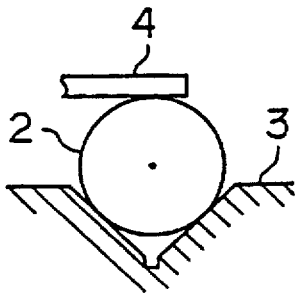
FIG. 3 is a side view of FIG. 2, in the z-direction.

FIG. 1 is a sectional diagram of a semiconductor single crystal ingot cutting jig according to the first embodiment of this invention; FIG. 2 shows that a head of an ingot is cut by a band saw slicing machine; FIG. 3 is a side view of FIG. 2, in the z-direction. An ingot-cutting jig 1 according to the first embodiment is cylindrical and is made of thermosetting resin. A diameter d of the jig is equal to or slightly less than the diameter of the ingot 2. A conical recess 1*a* is provided at one end of the jig 1 and is able to receive a greater part of a head 2*a* or tail 2*b* of the ingot 2. The shape of the recess 1*a* is formed so an to match both the head 2*a* and the tail 2*b*.

As shown in FIG. 2, the head 2*a* of the ingot 2 will be inserted into the ingot-cutting jig 1 when it is cut by the band saw slicing machine. An appropriate amount of adhesive (for example, NEOSEAL sealing compound) is applied to the recess 1*a* before the head 2*a* is inserted into the ingot-slicing jig 1. As a result, the adhesive is filled between the recess 1*a* and the head 2*a*, and the ingot 2 can be adhered to the ingot-cutting jig 1. In this state, as shown in FIG. 3, the ingot 2 is put in a work fixing V-groove of a bed 3 of the band saw slicing machine and is fixed by metal fastener 4.

Because the cut portion has been adhered to the jig 1, it does not overturn in the work fixing V-groove and separates from the ingot 2. Therefore, the blade of the band saw 5 will not get damaged. The tail 2*b* of the ingot 2 also has the same situation as the head. That is, the tail 2*b* is inserted into and adhered to the jig 1 to avoid damaging the blade of the band saw 5.

According to the ingot-cutting jig of the first embodiment, during the period of cutting the heads and tails of ingots, the blade of the band saw is not damaged absolutely. Also, the process of slicing the ingot body will become easy. Moving the body of the ingot during the period of cutting is not necessary, thus improving the efficiency of slicing work. And the kerf loss can be reduced 76%.

Figure 4:
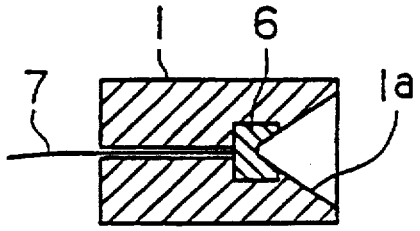
FIG. 4 is a sectional diagram of an ingot cutting jig according to the second embodiment of this invention.

FIG. 4 is a sectional diagram of an ingot-cutting jig according to the second embodiment of this invention, wherein the jig 1 further has a heater 6. The jig 1 is cylindrical and is made of stainless steel. The heater 6 is mounted at the lower position of the conical recess 1*a* of the jig 1. Reference number 7 is the wiring of the heater 6.

An appropriate amount of thermoplastic resin is applied to the recess 1*a*. Then, the resin is heated by the heater 6 and is therefore softened. Then the head (or tail) of the ingot 2 is inserted into the recess 1*a*. The softened thermoplastic resin is thus filled between the recess 1*a* and the head (or tail). Then, the power of the heater 6 is cut off and the thermoplastic resin is hardened so that the ingot can be adhered to the jig 1.

Figure 5:
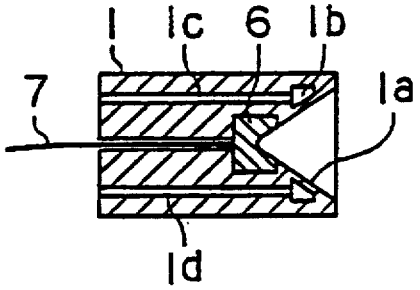
FIG. 5 is a sectional diagram of an ingot cutting jig according to the third embodiment of this invention.
Figure 6:
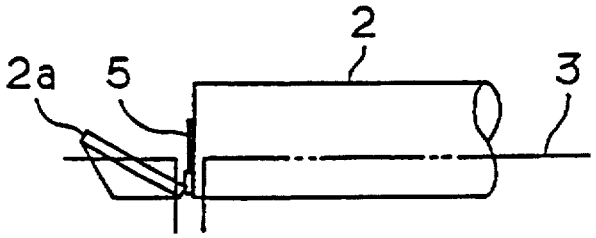
FIG. 6 shows that the head of an ingot is cut by a band saw slicing machine, without using an ingot cutting jig.
Figure 7:
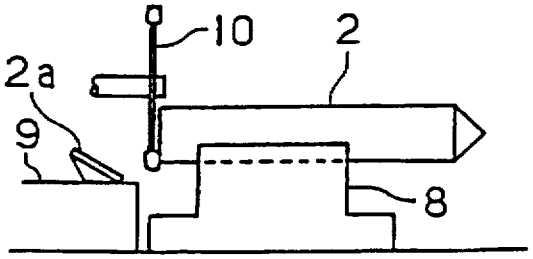
FIG. 7 shows that the head of an ingot is cut by an outer diameter saw slicing machine.

FIG. 5 is a sectional diagram of an ingot-cutting jig according to the third embodiment of this invention, wherein the ingot-cutting jig 1 further has a cooling water passage 1*b* around the recess 1*a*. Reference number 7 is the wiring of the heater 6; 1*c* is a cooling water feeding passage; and 1*d* is a cooling water discharging passage.

An appropriate amount of thermoplastic resin is applied to the recess 1*a*, heated by the heater 6 and then softened. The head (or tail) of the ingot is then inserted into the recess 1*a* so that the softened thermoplastic resin is filled between the recess 1*a* and the head (or tail) . The thermoplastic resin is hardened by cutting off the power of the heater 6 so that the ingot can be adhered to the ingot cutting jig 1. At this time, cooling water introduced from the water feeding passage 1*c* is allowed to flow into the water passage 1*b*, and then discharged from the water discharging passage 1*d*. This can facilitate hardening of the thermoplastic resin so that the later cutting process can be proceeded earlier.

Furthermore, an ingot cutting jig 1 according to another embodiment can comprises a metal cylinder, a vacuum pump and an adhesive applied on the surface of the metal cylinder which receives the head (or tail) of the ingot. Also, the cooling water feeding passage 1*c* and cooling water discharging passage 1*d* of the third embodiment can be replaced with the vacuum pump. By this arrangement, the head (or tail) of the ingot can be sucked and kept from falling down if the air in the jig is discharged by the vacuum pump.

As mentioned above, the head (or tail) of the ingot is adhered to the ingot-cutting jig. This can prevent the head or tail of an ingot from overturn on the bed, even when using the band saw slicing machine. It can also avoid damaging the blade of the band saw. Therefore, the band saw slicing machine can be used to cut ingot heads, tails and bodies, increasing the efficiency of the cutting processes and reducing the kerf loss during the processes. This increases the semiconductor wafer production rate and lowers production costs.

Although this invention has been described in its preferred forms and various examples with a certain degree of particularity, it is understood that the present disclosure of the preferred forms and the various examples can be changed in the details of construction. The scope of the invention should be determined by the appended claims and not by the specific examples given herein.

What is claimed is:

1. A semiconductor single crystal ingot holding device for holding a semiconductor single crystal ingot having a cylindrical-shaped body with a diameter and a conical-cone shaped head or tail; the device comprising a jig for holding the head or tail of the single crystal ingot, an adhesive, and means for holding the body of the single crystal ingot, the jig having a conical recess for receiving the head or tail of the single crystal ingot, the adhesive is filed in a clearance between the head or tail and the conical recess for adhering the ingot to the jig, wherein the jig is adapted to hold the head or tail of the single crystal ingot and the means is adapted to hold the body of the single crystal ingot, so that when the head or tail of the single crystal ingot is cut by a saw a resulting cut head or tail of the single crystal ingot is held away from the saw and does not damage the saw, and wherein the adhesive is thermoplastic resin, and the jig further comprises a heater provided near the conical recess to heat and soften the thermoplastic resin filled between the conical recess and the head or tail of the ingot.

2. A semiconductor single crystal ingot holding device for holding a semiconductor single crystal ingot having a cylindrical-shaped body with a diameter and a conical-cone shaped head or tail; the device comprising a jig for holding the head or tail of the single crystal ingot, an adhesive, and means for holding the body of the single crystal ingot, the jig having a conical recess for receiving the head or tail of the single crystal ingot, the adhesive is filed in a clearance between the head or tail and the conical recess for adhering the ingot to the jig, wherein the jig is adapted to hold the head or tail of the single crystal ingot and the means is adapted to hold the body of the single crystal ingot, so that when the head or tail of the single crystal ingot is cut by a saw, a resulting cut head or tail of the single crystal ingot is held away from the saw and does not damage the saw, and wherein the adhesive is thermoplastic resin, and the jig further comprises a heater provided near the conical recess to heat and soften the thermoplastic resin, and cooling water passages, also provided near the conical recess for introducing cooling water to cool and thereby hardened the softened thermoplastic adhesive.

* * * * *